US006245731B1

(12) United States Patent
Cossec et al.

(10) Patent No.: US 6,245,731 B1
(45) Date of Patent: Jun. 12, 2001

(54) DETERGENT TABLETS-PACKAGE COMBINATION

(75) Inventors: Bernard Cossec, Maison Laffitte; Jacky Pierre Duquet, Herbeville, both of (FR); Gregory Bruce Huntington, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/486,544

(22) PCT Filed: Aug. 14, 1998

(86) PCT No.: PCT/US98/16965

§ 371 Date: Feb. 28, 2000

§ 102(e) Date: Feb. 28, 2000

(87) PCT Pub. No.: WO99/11540

PCT Pub. Date: Mar. 11, 1999

(30) Foreign Application Priority Data

Sep. 1, 1997 (EP) ..... 97202674

(51) Int. Cl.[7] ..... C11D 17/04; C11D 3/395; C11D 7/54

(52) U.S. Cl. ..... 510/439; 510/294; 510/298; 510/302; 510/375; 510/446

(58) Field of Search ..... 510/439, 224, 510/294, 298, 446, 302, 375

(56) References Cited

U.S. PATENT DOCUMENTS

| | | | | |
|---|---|---|---|---|
| 3,471,597 | * | 10/1969 | Schirmer | 264/25 |
| 5,225,100 | * | 7/1993 | Fry et al. | 510/298 |
| 5,534,178 | * | 7/1996 | Bailly et al. | 510/367 |
| 5,552,851 | * | 9/1996 | Koboshi et al. | 354/298 |

FOREIGN PATENT DOCUMENTS

| | | | |
|---|---|---|---|
| 0576234 | * | 12/1993 | (EP) . |
| 0610535 | * | 8/1994 | (EP) . |
| 0634484 | * | 1/1995 | (EP) . |
| 5154964 | * | 6/1993 | (JP) . |
| 92 20593 | * | 11/1992 | (WO) . |
| 95/02677 | * | 1/1995 | (WO) . |
| 95/02681 | * | 1/1995 | (WO) . |
| 9513225 | * | 5/1995 | (WO) . |

* cited by examiner

*Primary Examiner*—Lorna M. Douyon
(74) *Attorney, Agent, or Firm*—Marianne Dressman; Kim William Zerby; Steven W. Miller

(57) ABSTRACT

The combination of packaging system comprising re-closing means with a stack of tablets (1) containing a bleaching agent unstable in a moisture environment, characterized in that the packaging device has a Moisture Vapor Transfer Rate of less than 20 g/m$^2$/day measured at 40° C. and 75% eRH for avoiding ingress of water is disclosed. The packaging system may also have a micro-hole to allow gas release.

8 Claims, 4 Drawing Sheets

DETERGENT TABLETS-PACKAGE COMBINATION

TECHNICAL FIELD

The present invention relates to a packaging system for a stack of tablets containing a bleaching agent.

BACKGROUND OF THE INVENTION

Packaging systems for stacks of tablets are widely used in food industry. Such packaging systems often take the form of a wrapper, sometimes a shrinkable wrapper, because such packaging systems are relatively easy to process at high speed and in large quantities. Because tablets are normally adapted so as to correspond to a basic consumer unit, the tablets are normally used the one after the other, and not all at once. In order to protect the remaining tablets after the first opening of the packaging system and up to use of the complete stack, it is often preferred to have the stack of tablets contained in a packaging system comprising re-closing means.

The present invention concerns a packaged product comprising the combination of a stack of tablets with a packaging system containing the stack of tablets, whereby the packaging system comprises re-closing means. Such a packaging system is known from WO92/20593 published on theof Nov. 7, 1992 for food product.

Among the advantages of such packaging systems is the fact that they are air-tight when closed, which is particularly adapted for packaging food products which are very sensitive to oxygen. Further, these packaging systems can be repeatedly re-closed.

However, air-tight packaging systems for food product are not adapted to packaging of chemical compositions, such as a bleaching agent. Indeed, if such materials are packed in an air-tight packaging system, the gas may be released within the package without being evacuated, thus deforming the packaging system and, in extreme cases, leading to explosion of the packaging system, as the content may release gas.

The invention seeks to provide a packaged product of the above mentioned kind which can protect tablets comprising chemical compositions which may also release gas.

SUMMARY OF THE INVENTION

In accordance with the invention, this object is accomplished with a packaged product of the above mentioned kind in that the tablets comprise a bleaching agent and the packaging system is formed from a material having a Moisture Vapour Transfer Rate of less than 20 $g/m^2/day$ measured at 40° C. and 75% Equilibrium Relative Humidity (eRH).

DETAILED DESCRIPTION OF THE INVENTION

A packaged product in accordance with the invention has a number of advantages. Since the material forming the packaging system has a Moisture Vapour Transfer Rate (MVTR) of less than 20 $g/m^2/day$, the ingress of water in the packaging system is limited, so that the stability of the bleaching agent can be maintained. Indeed, a bleaching agent is very sensitive to humidity, so that it decomposes in a humid environment. Furthermore, a bleaching agent may release gas. Gas release would be accelerated in a high temperature environment. Since the material forming the packaging system may have a micro-hole, gas would be evacuated out of the packaging system if pressure builds up within the packaging system, whereas gas transfer is very limited when the pressure inside the packaging system is in equilibrium with the external pressure. Indeed, a micro-hole is such that it will give way significantly only in case of a pressure gradient between the two sides of the hole. This is due to the resilience of the packing material. This is particularly adapted when combined with the package for the invention because the pressure gradient is normally such that pressure inside the package is always at least equal to the external pressure, so that water does not have any substantial access to the inside of the package, whereas gas release will be controlled. Consequently, such a packaged product would not induce a risk of explosion while efficiently protecting the tablets from decomposing.

The invention will now be described by way of example and with reference to the accompanying drawings in which.

Figure 1:
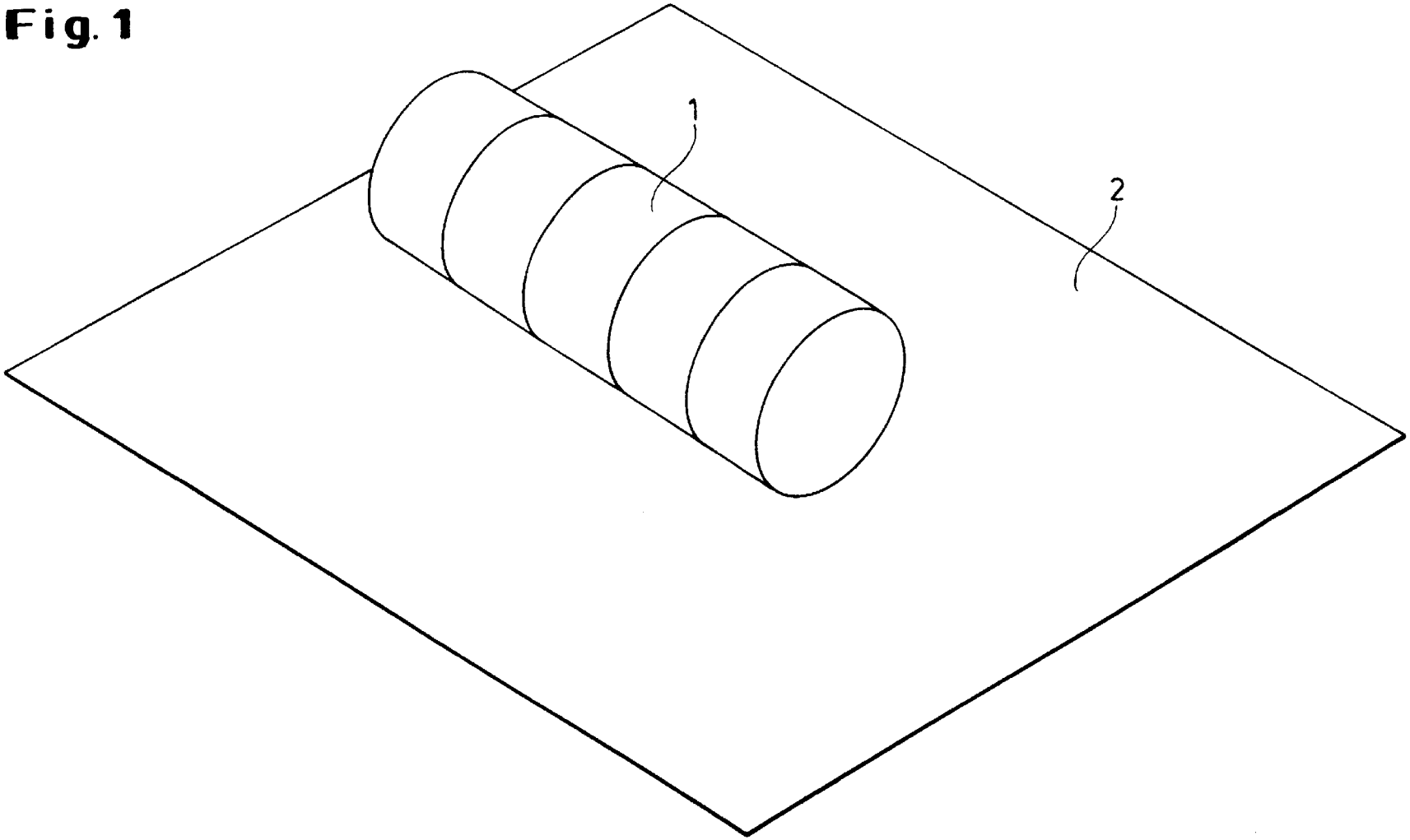
FIG. 1 is a perspective view of a flat film with a stack of tablets prior to wrapping.
Figure 2:
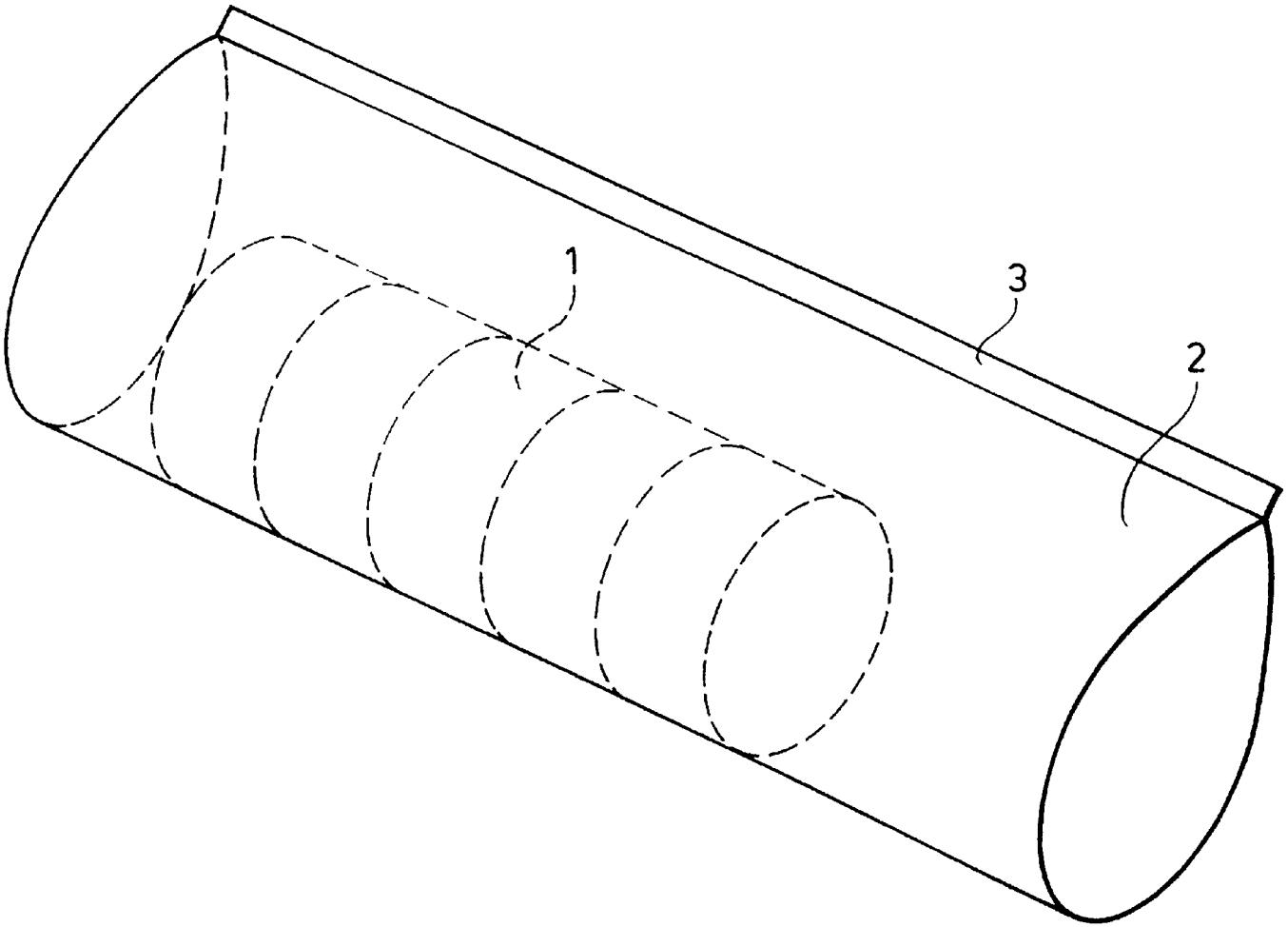
FIG. 2 is a perspective view of a stack of tablets in a sealed film.

The packaged product of the invention relates to a stack of tablets (1). Tablets are portions which may have various cross sections. The cross section is normally circular, but it may be rectangular, square or elliptical for example. Tablets can be grouped into a stack (1) by stacking them along their axis, thus forming a stack which has a shape having the same cross section than a tablet. A stack according to the invention may comprise two or more tablets, preferably 2 to 10 tablets, more preferably 5 or 6 tablets.

The tablets of the invention comprise a bleaching agent. Typically, the bleaching agent will be an inorganic per-hydrate bleach. Such bleaching agents comprise sodium per-borate, which may be in the form of the mono-hydrate or of the tetra-hydrate. Other per-hydrate salts can also be used, such as sodium per-carbonate. Such components are a useful source of carbonate ions for detergency purposes. However, such per-carbonates are particularly unstable in moisture and also release gas, such as oxygen. Therefore, the packaging system should be suitable so as to take account of these two features.

Because a bleaching agent is decomposing in moisture and consequently loosing its bleaching properties, it is important to protect the tablets from ingress of external moisture. Ideally, this could be achieved by packing each tablet in a separate package to open just prior to use, the package being completely water-impermeable. However, such an option is not environmentally friendly as it is maximising the number of packages used. On the other side of the range, the tablets could be delivered in only one bag, however, first opening of the bag would expose all tablets to the external environment. A compromise is preferable by grouping the tablets in relatively small numbers in a package in the form of a stack, in order to minimise the room occupied by the tablets, to reduce the number of packages and to minimise the exposition of tablets remaining in the once opened bag. In order to protect the tablet or tablets remaining in the packaging system after first opening, the packaging system can be re-closed. In order to achieve efficient protection of the tablets, it is needed that the packaging system has a limited Moisture Vapour Transfer Rate (MVTR). The MVTR of the packaging system is measured at 40° C. and 75% eRH, which corresponds to a environment particularly damaging for the tablets. It was found that the MVTR should not exceed 20 g/m$^2$/day in order to fulfil the requirements of the packaging system, corresponding to a protection effective for a six month period in real conditions. This protection is achieved prior to the first opening of the packaging system, indeed each further opening is potentially introducing moisture within the package, so that protection may not last for as long a time once the packaging system has been opened for the first time. This feature is used for choosing the number of tablets which compose a stack The packaging system should also take account of the fact that gas is released by its content. This may be achieved by a micro-hole which is made in the packaging system. A micro-hole would act as a communication between the inside of the packaging system and the outside of the packaging system. The main characteristics of a micro-hole is that the communication it provides is pressure sensitive. Indeed, if the pressure inside of the packaging system and the pressure outside of the packaging system are in equilibrium, the microhole will have a negligible influence on the transmission characteristics of the packaging system because of the resilience of the material. Indeed, no significant amount of the material is taken away when making a micro-hole, so that it will be substantially closed in the absence of a pressure gradient between the inside and the outside of the bag. However, once a pressure gradient appears, the packaging system will be slightly distorted, so that the micro-hole will open itself and allow significant communication between the outside and the inside of the package in order to minimise the pressure gradient. This is particularly adapted when combined with the invention. Indeed, when a pressure gradient is created, it is usually because the pressure inside the bag increases, as the external pressure is substantially a constant. This means that in case of release of a gas, the inner pressure will increase, thus creating a pressure gradient which will open the micro-hole, through which the excess of gas will be evacuated. The micro-hole is acting as a discharge orifice without letting moisture enter the bag in a significant manner as the external pressure is normally always lower or equal to the inner pressure. This mechanism can be tuned by using various sizes for the micro-holes as well as by choosing the number of micro-holes needed per packaging system, taking account of the composition and of the quantity of the content of the packaging system, and taking also account of the MVTR of the packaging system. Indeed, a non zero MVRR will allow some communication between the inside and the outside of the bag.

In a preferred embodiment of the present invention, the stack (1) is composed of five cylindrical tablets having a circular cross section. The tablets comprise a bleaching agent, and may also comprise other components such as fragrance, surfactants, enzymes, detergent etc. . . Typical tablet compositions for the preferred embodiment of the present invention are disclosed in the pending European applications of the Applicant n° 96203471.6, 96203462.5, 96203473.2 and 96203464.1 for example. It should be mentioned that the fragrance is usually composed of a particularly volatile composition, so that a low MVTR prevents not only ingress of water but egress of perfume.

The packaging system of the preferred embodiment is originally composed of a sheet of material (2) having the required MVTR. Materials suitable for this use include mono-layer, co-extruded or laminated films. Such films may comprise various components, such as poly-ethylene, poly-propylene, poly-styrene, poly-ethylene-terephtalate. In a most preferred embodiment of the invention, the packaging system is composed of a poly-ethylene and bi-oriented-poly-propylene co-extruded film with an MVTR of less than 1 g/day/m$^2$. The MVTR of the packaging system is preferably of less than 10 giday/m$^2$, more preferably of less than 5 g/day/m$^2$, even more preferably of less than 1 g/day/m$^2$ and most preferably of less than 0.5 g/day/m$^2$. The film (2) may have various thicknesses. The thickness should typically be between 10 and 150 $\mu$m, preferably between 15 and 120 $\mu$m, more preferably between 20 and 100 $\mu$m, even more preferably between 25 and 80 $\mu$m and most preferably between 30 and 40 $\mu$m.

The packaging system preferably comprises at least a micro-hole. There may also be more than 1 micro-hole. Preferably, there is between 1 and 10 micro-holes per packaging system, more preferably between 2 and 8 micro-holes, even more preferably between 2 and 5 micro-holes and most preferably 3 micro-holes. These micro-holes can be made using a pin. In the preferred embodiment of the present invention, the pin used has a 1 mm diameter, the head having a diameter of the order of 0.1 mm. The packaging system may be pinned prior to wrapping, for example using pins fixed onto a cylinder which rotates while the film roll passes to apply the micro-holes. Such micro-holes have a size of typically between 100 and 1000 $\mu$m, preferably between 250 and 900 $\mu$m, more preferably between 350 and 700 $\mu$m and most preferably between 400 and 500 $\mu$m. An advantage of using a micro-hole in combination with a material having the claimed MVTR is that the problem of the ingress of moisture and the problem of evacuation of gas is de-coupled. Indeed, ingress of moisture is readily controlled by choosing the appropriate MVRR, whereas a micro-hole has only a negligible influence on ingress of moisture because it is present only at some points on the packaging system without modifying the characteristics of the remaining surface of the packaging system and a micro-hole will not have a significant influence if there is no pressure gradient. As a pressure gradient will appear precisely when gas needs to be evacuated to prevent deformation of the packaging system, the micro-hole will fulfil its function without significant influence on the ingress of moisture.

Figure 3:
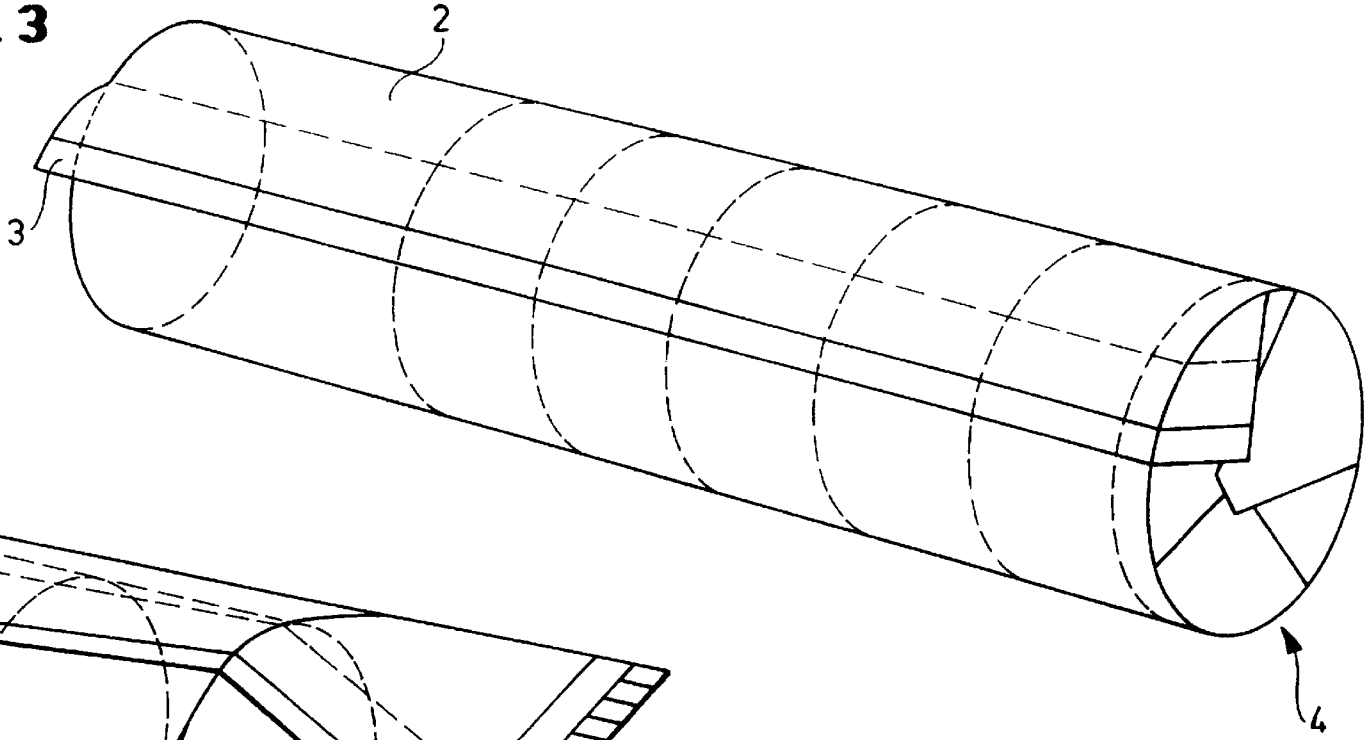
FIG. 3 is a perspective view of a stack of tablet in an over-wrapped film.
Figure 4:
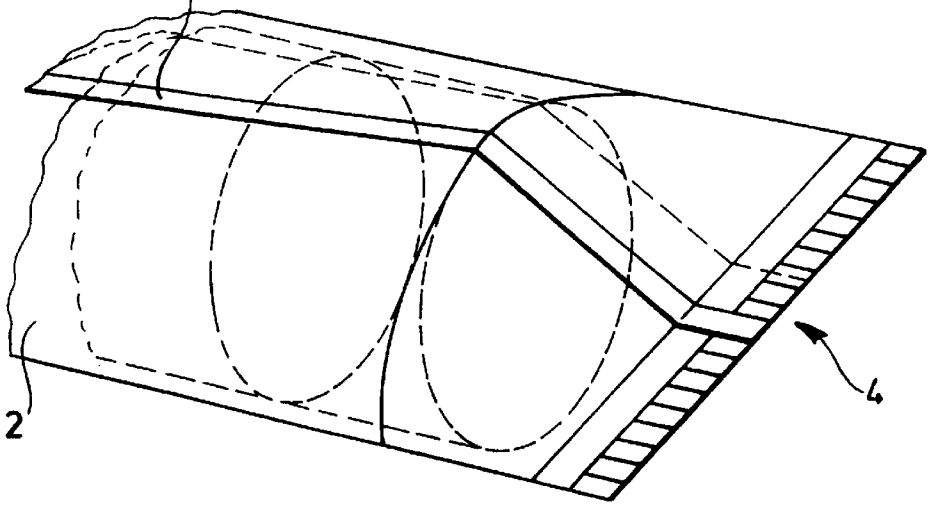
FIG. 4 is a perspective view of a stack of tablets in a flow-wrapped film.
Figure 5:
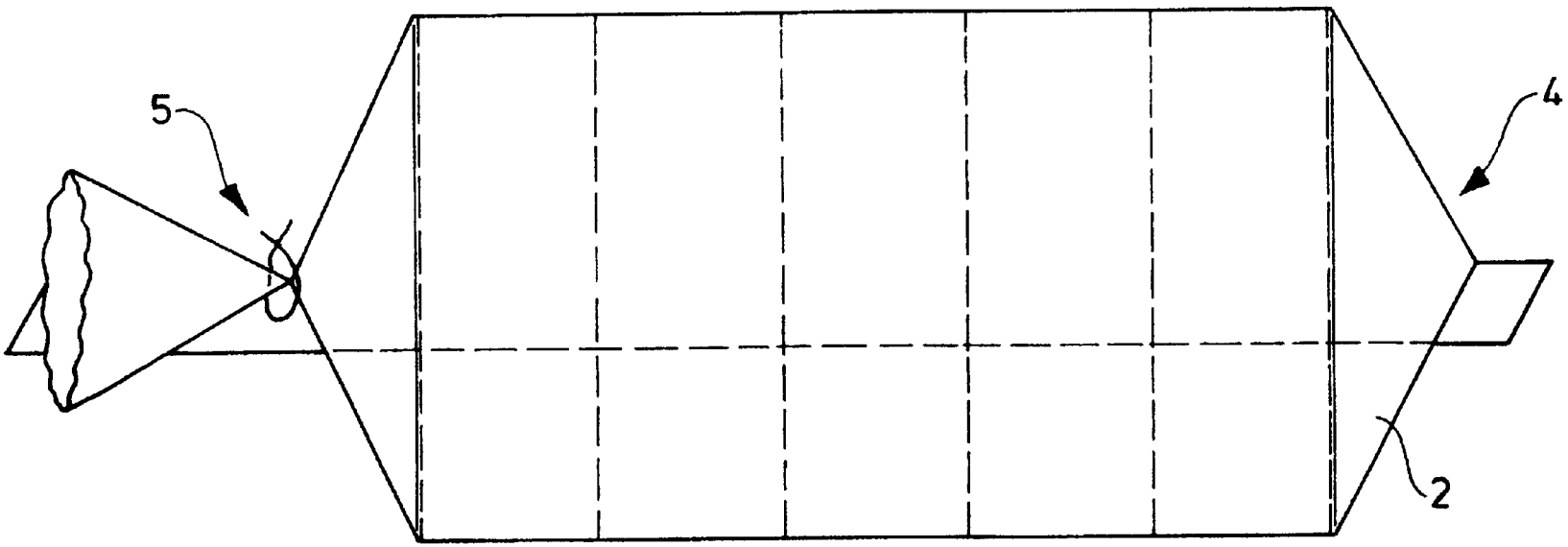
FIG. 5 is an elevation view of a packaging system according to the present invention.

The stack of tablets can be wrapped after being deposed onto the packaging system. The packing method used are typically the wrapping methods disclosed in WO92/20593, including flow wrapping (FIG. 4) or over wrapping (FIG. 3). This document is included as a reference for the present invention. When using such processes, a first longitudinal seal is provided (3), which may be a fin seal or an overlapping seal, after which a first end (4) of the packaging system is closed, followed by closure of the second end (5). The re-closing means may also comprise means as described in WO92/20593. In particular, using a twist, a cold seal or an adhesive is particularly suited to the packaging system of the present invention. Indeed, a band of cold seal or a band of adhesive may be applied to the surface of the packaging system at a position adjacent to the second end of the packaging system, so that this band may provide both the initial seal and re-closure of the packaging system. In such a case the adhesive or cold seal band may correspond to a region having a cohesive surface, i.e. a surface which will adhere only to another cohesive surface. Such reclosing means may also comprise spacers which will prevent unwanted adhesion. Such spacers are described in WO 95/13225, published on the 18$^{th}$ of May 1995. There may also be a plurality of spacers and a plurality of strips of adhesive material. The main requirement is that the communication between the exterior and the interior of the package should be minimal, even after first opening of the packaging system. In a preferred embodiment of the present invention, a cold seal is used, and in particular a grid of cold seal, whereby the cold seal is adapted so as to facilitate opening of the packaging system.

Preferably, the tablets of the invention are containing a detergent composition. More preferably, the detergent composition is a laundry additive composition containing from 20% to 80% by weight of a per-hydrate bleach. Protection against moisture is an issue which is more acute for detergent tablets than for usual detergent powders. Indeed, when exposed to moisture, a first effect on detergent compositions is to soften its structure and consistency. This change in consistency of the detergent composition due to moisture does not always have significant consequences on the chemical properties of the detergent. However, a change in structure will be significant for the tablets because they are likely to break, thus making use awkward and unpleasant. However, this does not apply to powders in a granular form as dosing is made by scooping the powder.

What is claimed is:

1. A packaged product comprising the combination of a stack of tablets with a packaging system containing the stack of tablets, whereby the packaging system comprises re-closing means, wherein the tablets comprise a bleaching agent and the packaging system is formed from a material having a Moisture Vapor Transfer Rate of less than 20 g/m$^2$/day measured at 40° C. and 75% Equilibrium Relative Humidity and further wherein the packaging system comprises at least a micro-hole.

2. A packaged product as in claim 1, whereby the re-closing means comprise a cold seal.

3. A packaged product as in claim 1, whereby the bleaching agent is a sodium per-carbonate.

4. A packaged product as in claim 1, whereby the tablet further comprises a detergent.

5. A packaged product as in claim 1, whereby the tablet further comprises a perfume.

6. A packaged product as in claim 1, whereby the packaging system comprises two micro-holes.

7. The packaged product of claim 1 wherein said tablet is a laundry additive composition, containing from 20% to 80% by weight of a per-hydrate bleach.

8. The packaged product of claim 1 wherein said packaging system is made using a flow wrapping process.

* * * * *